US011560660B2

(12) United States Patent
Lee et al.

(10) Patent No.: US 11,560,660 B2
(45) Date of Patent: Jan. 24, 2023

(54) LAUNDRY TREATING APPARATUS

(71) Applicant: LG Electronics Inc., Seoul (KR)

(72) Inventors: Kilryong Lee, Seoul (KR); Junyoung Kim, Seoul (KR); Jungsang You, Seoul (KR)

(73) Assignee: LG Electronics Inc., Seoul (KR)

( * ) Notice: Subject to any disclaimer, the term of this patent is extended or adjusted under 35 U.S.C. 154(b) by 243 days.

(21) Appl. No.: 16/844,379

(22) Filed: Apr. 9, 2020

(65) Prior Publication Data

US 2020/0325611 A1 Oct. 15, 2020

(30) Foreign Application Priority Data

Apr. 10, 2019 (KR) ..... 10-2019-0041899

(51) Int. Cl.

| | |
|---|---|
| ***D06F 34/08*** | (2020.01) |
| ***D06F 39/08*** | (2006.01) |
| ***D06F 34/34*** | (2020.01) |
| ***D06F 37/22*** | (2006.01) |
| ***D06F 37/30*** | (2020.01) |
| ***D06F 39/12*** | (2006.01) |

(52) U.S. Cl.

CPC ..... *D06F 34/08* (2020.02); *D06F 34/34* (2020.02); *D06F 37/22* (2013.01); *D06F 37/30* (2013.01); *D06F 39/085* (2013.01); *D06F 39/12* (2013.01)

(58) Field of Classification Search

CPC ..... D06F 34/08; D06F 34/34; D06F 37/22; D06F 37/30; D06F 39/085; D06F 39/12

USPC ..... 68/12.19

See application file for complete search history.

(56) References Cited

U.S. PATENT DOCUMENTS

| | | | | |
|---|---|---|---|---|
| 2,225,407 | A * | 12/1940 | Bassett, Jr. | D06F 34/08 68/140 |
| 3,970,354 | A * | 7/1976 | Hopkins | H01R 13/629 439/571 |
| 8,828,148 | B2 * | 9/2014 | Poyner | A47L 15/4251 134/57 D |
| 10,011,937 | B2 * | 7/2018 | Borlin | D06F 37/265 |
| 2005/0155394 | A1 * | 7/2005 | Brauchle | H05K 5/0004 68/3 R |
| 2005/0217323 | A1 * | 10/2005 | Lee | D06F 37/22 68/23.1 |
| 2007/0169521 | A1 * | 7/2007 | Kim | D06F 33/36 68/5 R |

(Continued)

FOREIGN PATENT DOCUMENTS

| | | | |
|---|---|---|---|
| DE | 10232442 | 11/2003 | |
| DE | 112014002821 | 3/2016 | |
| WO | WO-2011147676 A1 * | 12/2011 | D06F 39/00 |

OTHER PUBLICATIONS

Office Action in German Appln. No. 102020204627.1, dated May 11, 2022, 18 pages (with English translation).

*Primary Examiner* — David G Cormier
*Assistant Examiner* — Thomas Bucci
(74) *Attorney, Agent, or Firm* — Fish & Richardson P.C.

(57) ABSTRACT

In a laundry treating apparatus, flat surfaces are installed at both sides of a tub for storing water therein, so that a spacing between each of the both sides of the tub and each side of a cabinet is smaller than a spacing between a lower surface of the tub and a bottom of the cabinet. Further, a control panel is disposed between the lower surface of the tub and the bottom of the cabinet.

20 Claims, 12 Drawing Sheets

(56) References Cited

U.S. PATENT DOCUMENTS

| | | | | |
|---|---|---|---|---|
| 2007/0285261 | A1* | 12/2007 | Lee | D06F 39/081 340/623 |
| 2008/0250824 | A1* | 10/2008 | Oh | D06F 39/083 68/5 C |
| 2009/0165833 | A1* | 7/2009 | Rehm | A47L 15/46 68/12.02 |
| 2009/0205378 | A1* | 8/2009 | Helgesen | D06F 39/12 68/3 R |
| 2009/0205690 | A1* | 8/2009 | Gault | A47L 15/4293 134/56 D |
| 2010/0212957 | A1* | 8/2010 | Hotz | A47L 15/4251 174/72 A |
| 2011/0107798 | A1* | 5/2011 | Kawaguchi | D06F 37/20 68/19 |
| 2011/0232336 | A1* | 9/2011 | Hong | D06F 37/00 68/140 |
| 2012/0090362 | A1* | 4/2012 | Hwang | D06F 37/22 68/139 |
| 2012/0151972 | A1* | 6/2012 | Jung | D06F 25/00 312/228 |
| 2013/0145799 | A1* | 6/2013 | Lee | D06F 21/00 68/139 |
| 2015/0322616 | A1* | 11/2015 | Dal Ben | D06F 34/10 62/238.7 |
| 2017/0145618 | A1* | 5/2017 | Borlin | D06F 37/265 |
| 2019/0374086 | A1* | 12/2019 | Saponaro | D06F 39/088 |
| 2020/0165765 | A1* | 5/2020 | Meyer | A47L 15/4253 |
| 2020/0220343 | A1* | 7/2020 | Willis, Jr. | D06F 34/04 |

* cited by examiner

LAUNDRY TREATING APPARATUS

CROSS-REFERENCE TO RELATED APPLICATION

This application claims the benefit of Korean Patent Application No. 10-2019-0041899, filed on Apr. 10, 2019, which is hereby incorporated by reference as if fully set forth herein.

BACKGROUND

Field

The present disclosure relates to a laundry treating apparatus.

Discussion of the Related Art

A laundry treating apparatus is a concept encompassing an apparatus for washing laundry, an apparatus for drying the laundry, and an apparatus for washing or drying the laundry based on a user's selection. Conventional laundry treating apparatuses may be divided into a front loading type of putting the laundry into the apparatus through a laundry inlet defined in a front face of the apparatus, and a top loading type of putting the laundry into the apparatus through a laundry inlet defined in a top face of the apparatus.

When the conventional laundry treating apparatus is a washing machine, the conventional laundry treating apparatus includes a cabinet forming an outer shape thereof, a tub for storing water therein, and a drum rotatably received in the tub and storing the laundry therein. When the conventional laundry treating apparatus is a drier, the tub may be omitted. Therefore, the tub and the drum may be collectively referred to as a laundry receiving portion.

In this connection, the larger the volume of the laundry receiving portion, the more the amount of laundry that may be washed or dried by the laundry treating apparatus in one operation. Accordingly, the laundry treating apparatus may aim to increase the amount of laundry that may be processed in one operation by increasing the volume of the laundry receiving portion.

However, the increase in the laundry receiving portion is accompanied by an increase in a volume of the cabinet. Because a space in which the laundry treating apparatus is installed is limited, when the volume of the cabinet increases, installation of the laundry treating apparatus itself is not possible. Therefore, the conventional laundry treating apparatus has a limitation in that the volume of the laundry receiving portion is not able to be increased due to restrictions on an installation space.

In addition, recently, as one-person households are increased and miniaturized residential spaces are spread, there is a demand of consumers for a reduction in the volume of the cabinet. However, even for the one-person households, washing of bulky laundry such as a blanket, a coat, or the like is required. Therefore, there is also a need to maintain or increase the volume of the laundry receiving portion as in the prior art. However, in the conventional laundry treating apparatus, collision between the laundry receiving portion and the cabinet due to vibration generated in the laundry receiving portion should be prevented. Therefore, the volume of the laundry receiving portion was not able to be increased.

In addition, in the conventional laundry treating apparatus, an input unit for inputting a command of the laundry treating apparatus, or a display for displaying a state is installed on a top of the cabinet. Accordingly, a control panel connected to the input unit and the display may also be disposed on the top or a front face of the cabinet. In this situation, when the volume of the laundry receiving portion is expanded, a top of the laundry receiving portion and the control panel may become close to each other or may be brought into contact with each other. Therefore, even when a laundry treating apparatus with a laundry receiving portion having a larger volume appears, the laundry treating apparatus has a limitation in that the vibration of the laundry receiving portion may be transmitted to the control panel or the laundry receiving portion itself may collide with the control panel, thereby damaging the control panel or not guaranteeing a function of the control panel.

In one example, in the conventional laundry treating apparatus, a suspension for supporting the laundry receiving portion may be installed between a bottom of the laundry receiving portion and a base forming a bottom face of the cabinet. The suspension is disposed as a damper or a spring to damp the vibration of the laundry receiving portion. Therefore, it is common that a space between the bottom of the laundry receiving portion and the base is larger than a space between the top of the laundry receiving portion and the top face of the cabinet.

In one example, the tub is a component for receiving the water therein, and it is common that the tub is formed by assembling several components with each other. Thus, there is a possibility of water leakage. Therefore, despite a sufficient space between the tub and the base, installation of a separate electronic product is limited.

SUMMARY

A purpose of the present disclosure is to provide a laundry treating apparatus in which a volume of a laundry receiving portion that is disposed in a cabinet having a limited volume to provide a space for receiving water therein may be maximized.

Further, another purpose of the present disclosure is to provide a laundry treating apparatus that may minimize transmission of vibration of a laundry receiving portion to a cabinet.

Further, another purpose of the present disclosure is to provide a laundry treating apparatus that may secure an installation space of a control panel that controls the laundry treating apparatus even when a volume of a laundry receiving portion is expanded.

Further, another purpose of the present disclosure is to provide a laundry treating apparatus that may further expand a volume of a laundry receiving portion by installing a control panel at a position between a bottom of the laundry receiving portion and a bottom face of the cabinet.

Further, another purpose of the present disclosure is to provide a laundry treating apparatus that, in consideration of occurrence of a free space resulted from a change in a suspension disposition in a process of changing a shape of a laundry receiving portion and bringing the laundry receiving portion closer to a cabinet, may install a control panel in the free space.

Further, another purpose of the present disclosure is to provide a laundry treating apparatus that a harness for connecting a control panel with a driver received in a laundry receiving portion or a harness for connecting the control panel with a display that displays a state of the laundry treating apparatus may be installed on a base.

Further, another purpose of the present disclosure is to provide a laundry treating apparatus that may allow water to be removed from a control panel even when the water leaked from a tub comes into contact with the control panel.

The laundry treating apparatus according to the present disclosure may include suspensions arranged on one side and the other side of the laundry receiving portion asymmetrically to solve the above-described problem. Therefore, the control panel may be installed on a portion of the base of the cabinet where the relatively smaller number of suspensions are installed.

In addition, the laundry treating apparatus according to the present disclosure may place one or more harnesses connecting the control panel, the driver, and the display panel with each other on a portion of the base of the cabinet where the relatively greater number of suspensions are installed.

Thus, while maximizing a space utilization of the base, a space between a top face of the cabinet and a top or a front face of the laundry receiving portion may be further secured. As a result, a space in which the laundry receiving portion may be further extended toward the top or the front face of the cabinet may be further secured.

In addition, the laundry treating apparatus according to the present disclosure may position the control panel on the base to be biased to a rear portion of the cabinet. Thus, a length of a harness for connecting the control panel and the driver with each other may be reduced as much as possible. Furthermore, the water discharge pump disposed on a front portion of the base and the control panel may be spaced apart as much as possible.

In addition, the laundry treating apparatus according to the present disclosure may position the suspension at a location between the control panel and the base. That is, the control panel and the base may be arranged to be separated from each other on left and right or front and rear sides of the suspension. As a result, a space around the suspension may be actively utilized.

In addition, the laundry treating apparatus according to the present disclosure may have a drain groove defined in a top of the control panel to induce water leaked to the top of the control panel to be immediately collected and removed. The drain groove may have a slope that is lowered toward one side of the control panel.

In addition, the laundry treating apparatus according to the present disclosure may include a buffer member that supports the control or receives the control panel therein to block vibration from being transmitted to the control panel. Thus, the control panel is disposed on the base to ensure sufficient vibration resistance even when the vibration is transmitted to the control panel.

According to the present disclosure, the volume of the laundry receiving portion that is disposed in the cabinet having the limited volume to provide the space for receiving the water therein may be maximized.

Further, according to the present disclosure, the laundry treating apparatus that may minimize the transmission of the vibration of the laundry receiving portion to the cabinet may be provided.

Further, according to the present disclosure, the installation space of the control panel that controls the laundry treating apparatus may be secured even when the volume of the laundry receiving portion is expanded.

Further, according to the present disclosure, the volume of the laundry receiving portion may be further expanded by installing the control panel at a location between the bottom of the laundry receiving portion and the bottom face of the cabinet.

Further, according to the present disclosure, the control panel may be installed in the free space in consideration of the occurrence of the free space resulted from the change in the suspension disposition in the process of changing the shape of the laundry receiving portion and bringing the laundry receiving portion closer to the cabinet.

Further, according to the present disclosure, the harness for connecting the control panel with the driver received in the laundry receiving portion or the harness for connecting the control panel with the display that displays the state of the laundry treating apparatus may be installed on the base.

Further, according to the present disclosure, the water may be induced to be removed from the control panel even when the water leaked from the tub comes into contact with the control panel.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DESCRIPTION OF SPECIFIC EMBODIMENTS

Figure 1:
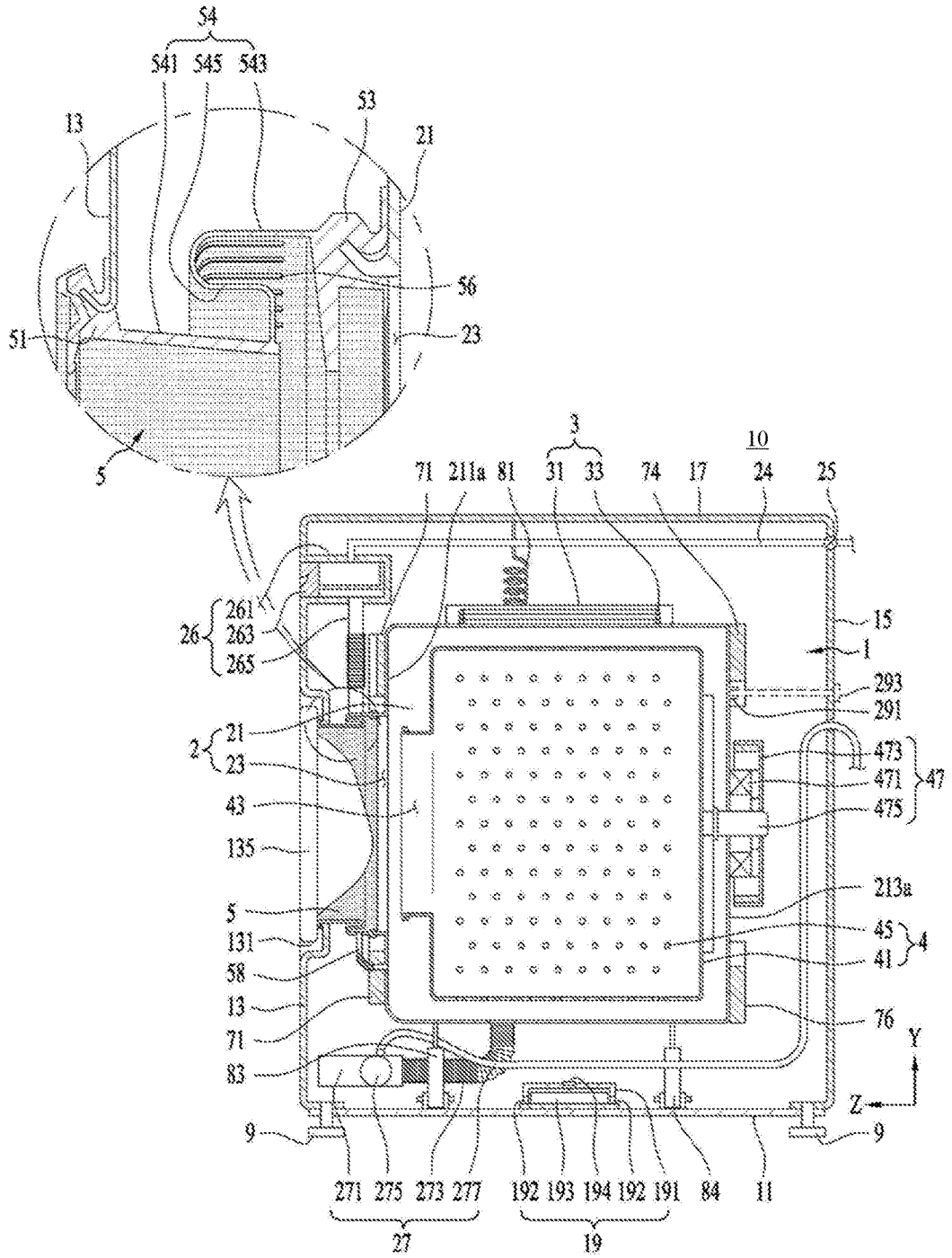
FIG. 1 illustrates an example of a laundry treating apparatus according to the present disclosure.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As shown in FIG. 1, a laundry treating apparatus 10 according to the present disclosure may include a cabinet 1 and a laundry receiving portion defined inside the cabinet to receive laundry therein. When the laundry treating apparatus 10 is provided as a washing machine, the laundry receiving portion may include a tub 2 received in the cabinet to store water therein, and a drum 4 rotatably disposed inside the tub to store the laundry therein. In addition, when the laundry treating apparatus 10 is provided as a dryer, the laundry receiving portion may omit the tub and may include only the drum.

Hereinafter, a description is achieved by assuming that the laundry treating apparatus 10 is provided as the washing machine, but this is for illustration only. The description may be equally applied even when the laundry treating apparatus 10 is provided as the dryer.

The cabinet 1 has a base 11 forming a bottom face of the laundry treating apparatus, a front panel 13 forming a front face of the laundry treating apparatus, a rear panel 15 forming a rear face of the laundry treating apparatus, a top panel 17 forming a top face of the laundry treating apparatus, and a first side panel 161 (see FIG. 3) and a second side panel 163 fixed to the base and respectively forming a left side face and a right side face of the laundry treating apparatus.

The front panel 13 is fixed to at least one of the base 11 and the side panels 161 and 163. Further, the front panel 13 may have a first laundry inlet 131 defined therein through which laundry enters and exits. The first laundry inlet 131 may be opened and closed by a door 135.

The first side panel 161, the second side panel 163, and the rear panel 15 may be integrally formed. That is, the first side panel, the second side panel, and the rear panel may be formed by bending one plate in a shape corresponding to edges of the base 11.

The tub 2 includes a hollow cylindrical tub body 21, a front cover 211*a* fixed to the tub body to form a front face of the tub, and a rear cover 213*a* fixed to the tub body to form a rear face of the tub.

The front cover 211*a* may be directed in a direction toward the front panel 13, and the rear cover 213*a* may be directed in a direction toward the rear panel 15. A second laundry inlet 23 in communication with the first laundry inlet 131 may be defined in the front cover 211*a*.

The first laundry inlet 131 and the second laundry inlet 23 are connected with each other through a vibration isolator 5. The vibration isolator 5 is preferably made of an elastic material such as rubber.

The vibration isolator 5 may be disposed to minimize transmission of vibration generated from the tub body 21 to the cabinet 1. The vibration isolator 5 may include a ring shaped first fixed body 51 fixed to the first laundry inlet 131, a ring shaped second fixed body 53 fixed to the second laundry inlet 23, and a connecting portion 54 disposed to connect the first fixed body 51 and the second fixed body 53 with each other and having a shape in which at least two inflection points are provided. The connecting portion 54 may be disposed as a rubber tube having an S-shaped cross-section. That is, the connecting portion 54 may include a pipe-shaped first extending body 541 extending from the first fixed body 51 toward the second laundry inlet 23, a pipe-shaped second extending body 543 extending from the second fixed body 53 toward the inlet 131, and a curved portion 545 connecting the first extending body 541 and the second extending body 543 with each other, and having the at least two inflection points.

It is preferable that a thickness of the curved portion 545 is smaller than a thickness of the first extending body 541 and a thickness of the second extending body 543. Even when the vibration isolator 5 is made of the elastic material such as the rubber, the thicker the connecting portion 54, the more vibration of the tub body 21 may be transmitted to the cabinet 1. Therefore, when the thickness of the curved portion 545 is smaller than the thicknesses of the two extending bodies 541 and 543, the transmission of the vibration of the tub body 21 to the cabinet may be effectively blocked.

Unlike as described above, one of the first extending body 541 and the second extending body 543 may have the thickness equal to the thickness of the curved portion 545, and the other of the first extending body 541 and the second extending body 543 may have the thickness greater than the thickness of the curved portion 545. FIG. 1 illustrates a case in which the thickness of the curved portion 545 is smaller than the thickness of the first extending body 541 and the thickness of the second extending body 543 is equal to the thickness of the curved portion 545 as an example.

However, when the thickness of the connecting portion 54 becomes too small, a risk of tearing the vibration isolator 5 because of the vibration of the tub body 21 increases. To prevent this, the vibration isolator 5 may further include a rib 56. The rib 56 is means disposed on the second extending body 543 to reinforce a strength of the connecting portion 54. The rib 56 may be a bar-shaped protrusion disposed along a direction from the second fixed body 543 toward the curved portion 545. A plurality of ribs 56 of the above-described structure may be arranged to be spaced apart from each other along a circumferential face of the second extending body 543.

In one example, in the vibration isolator 5 having the above-described structure, a possibility of water of remaining in the connecting portion 54 may not be excluded. In order to prevent the water from remaining inside the vibration isolator 5, the laundry treating apparatus according to the present disclosure may further include a residual water discharge pipe 58 for guiding the water inside the vibration isolator 5 to the tub body 21. The residual water discharge pipe 58 may be disposed as a pipe connecting the second extending body 543 and the front cover 211*a* with each other.

It is preferable that one end of the residual water discharge pipe 58 is fixed to a region located below a horizontal line H passing through a center of the second extending body in a space provided by the second extending body, and the other end of the residual water discharge pipe 58 is fixed to a region located below the horizontal line H passing through a center of the second laundry inlet 23 in a space provided by the front cover 211*a*. This is for moving the water inside the vibration isolator 5 to the tub body 21 without a separate apparatus such as a water discharge pump (see FIG. 3).

In one example, the tub body 21 may receive the water through a water supply, and the water stored in the tub body may be discharged to an outside of the cabinet 1 through a water discharger 27. The water supply may include a water supply pipe 24 for connecting a water source with the tub body 21, and a water supply valve 25 for opening or closing the water supply pipe based on a control signal of a controller (not shown).

When a detergent supply 26 for supplying detergent into the tub body 21 is disposed in the laundry treating apparatus 10 according to the present disclosure, the water supply pipe 24 may be disposed to supply the water to the detergent supply 26.

The detergent supply 26 may include a casing 261 fixed to an interior of the cabinet 1, a drawer 263 that may be withdrawn from the casing to the outside of the cabinet 1, and a connecting pipe 265 for connecting a bottom face of the casing with the vibration isolator 5.

The drawer 263 may include a storage that provides a space for storing the detergent therein, and a siphon channel disposed in the storage to discharge liquid inside the storage to the casing 261 when a water level in the storage exceeds a preset reference water level. In this case, the water supply pipe 24 will be disposed to supply the water to the storage of the drawer. A user may withdraw the drawer 263 from the casing 261 through a drawer entrance (not shown) penetrating the front panel 13.

The water discharger 27 may include a chamber 271 located inside the cabinet 1, a first water discharge pipe 273 for guiding the water inside the tub body 21 to the chamber 271, a pump 275 for pressurizing the water flowed into the chamber 271, and a second water discharge pipe 277 for guiding the water discharged from the pump to the outside of the cabinet 1.

The drum 4 may be disposed as a hollow cylindrical drum body 41. A third laundry inlet 43 may be defined in a front face (a face facing the front cover) of the drum body 41. The third laundry inlet 43 is defined at a position corresponding to the second laundry inlet 23 (the third laundry inlet is defined to communicate with the second laundry inlet). Accordingly, the laundry supplied through the second laundry inlet 23 may move to the drum body 41 through the third laundry inlet 43.

The drum 4 further includes a plurality of through-holes 45 defined to penetrate the drum body 41, and the through-hole 45 is means for communicating the tub body 21 and the drum body 41 with each other. Therefore, the water stored in the tub body 21 may flow into the drum body 41 through the through-holes 45, and the water inside the drum body 41 may flow to the tub body 21 through the through-holes 45.

The drum 4 is rotated by a driver 47. The driver 47 may include a stator 471 fixed to the rear cover 213*a* and located outside the tub body 21, a rotor 473 rotating by a rotating magnetic field provided by the stator, a rotation shaft 475 disposed to penetrate the rear cover 213*a* to connect the drum body 41 and the rotor 473 with each other.

In the laundry treating apparatus 10 according to the present disclosure, a heater 3 for drying the laundry may be further disposed. The heater 3 may include a housing 31 fixed to a circumferential face of the tub body 21, and a coil 33 fixed inside the housing, and generating an eddy current in the drum body 41 when a current is supplied.

A fixing portion that prevents the tub body 21 from colliding with the cabinet 1 during transportation of the laundry treating apparatus 10 according to the present disclosure may be further included. The fixing portion is means for connecting the rear cover 213*a* to the rear panel 15 of the cabinet. The fixing portion may include a boss 291 disposed on the rear cover 213*a*, and a fixing bolt 293 fastened to the boss by penetrating the rear panel 15 of the cabinet. When the transportation is completed, the fixing bolt 293 may be separated from the cabinet 1.

A water leakage sensor 19 may be further included in the present disclosure. The water leakage sensor 19 is means for determining whether the water supplied into the tub body 21 leaks to the base 11. The water leakage sensor 19 may include a cylindrical housing 191 fixed to the base 11, a plurality of inlets 192 that communicate a receiving space defined in the housing with the outside, an actuator 193 located inside the receiving space, and a sensing portion 194 fixed to a top of the housing 191. When the water leaks to the base 11, the actuator 193 moves toward a top face of the housing 191 by buoyancy of the water. Further, when the actuator 193 is in contact with the sensing portion 194, the sensing portion 194 may transmit a signal to a controller (not shown). In this case, the controller may stop the operation of the driver 47 and notify the user of the water leakage through a display (not shown) or a speaker provided in the cabinet. The water leakage sensor 19 is preferably disposed at the lowest position in a space provided by the base 11 such that the water leakage may be immediately sensed.

In order to improve a washing performance, the laundry treating apparatus 10 according to the present disclosure may further include a water ejector 6 spraying the water stored in the tub body 21 to the laundry through the second laundry inlet 23 and the third laundry inlet 43. A structure of the water ejector will be described below.

Figure 2:
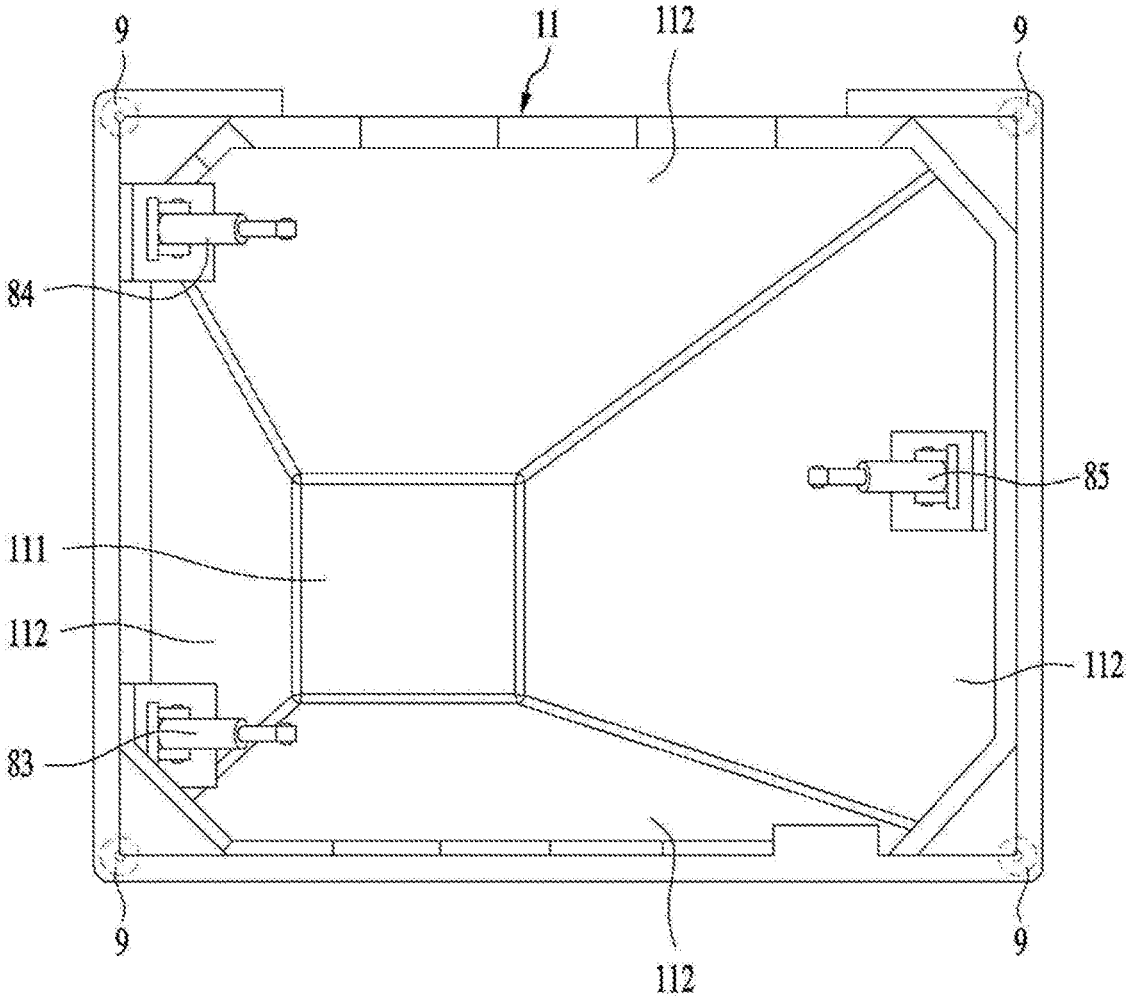
FIG. 2 illustrates an example of a base included in the present disclosure.

FIG. 2 illustrates an example of a base included in the present disclosure.

The base 11 may include a sensor installation face 111 and a plurality of inclined faces 112 inclined downward from edges of the base toward the sensor installation face 111. The water leakage sensor 19 is disposed on the sensor installation face 111 to immediately sense the water leakage.

Figure 3:
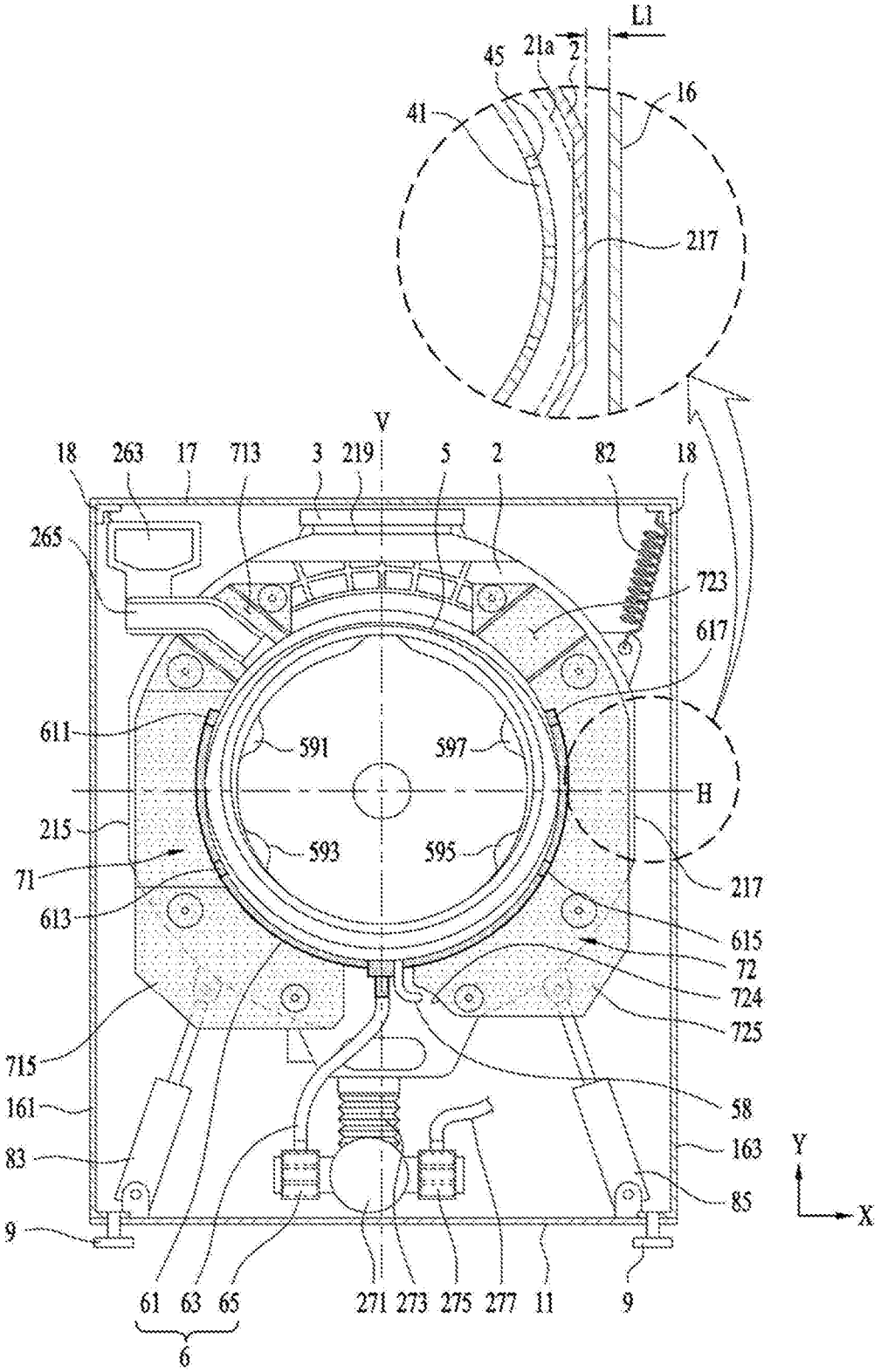
FIGS. 3 to 5 illustrate an example of a tub and tub support provided in the present disclosure.

FIG. 3 illustrates a structure of the laundry treating apparatus viewed from the front.

The tub body 21 is fixed inside the cabinet 1 through a tub support 81, 82, 83, 84, and 85. The tub support may include an elastic force providing portion 81 and 82 and a damping portion 83, 84, and 85.

The damping portion may include a plurality of dampers 83, 84, and 85 connecting a region of a circumferential face of the tub body 21 below the horizontal line H passing through a center of the tub body with the base 11. The damping portion may include a first damper 83 and a second damper 84 located on one side of a vertical line V passing through the center of the tub body 21 and connecting the base 11 with the lower region of the tub body 21, and a third damper 85 located on the other side of the vertical line V and connecting the base 11 with the lower region of the tub body 21. The plurality of dampers 83, 84, and 85 may include a cylinder fixed to the base 11, and a piston connecting the cylinder with the tub body 21. One end of the piston is fixed to the tub body 21, and the other end thereof is coupled to the cylinder to reciprocate inside the cylinder.

The elastic force providing portion may include a first spring 81 and a second spring 82 connecting a region of the circumferential face of the tub body 21 above the horizontal line H passing through the center of the tub body with the cabinet 1. In this case, the cabinet 1 may further include each frame 18 to which each spring is fixed. The frame 18 may include a first frame disposed at a corner where the first side panel 161 and the top panel 17 meet to fix the first spring 81, and a second frame disposed at a corner where the second side panel 163 and the top panel 17 meet to fix the second spring 82.

The water ejector 6 may include a channel body 61 fixed to the front cover 211*a* of the tub body and positioned in a space between an edge of the vibration isolator 5 and a front load portion of the first and second balancers 71 and 72, a supply pipe 63 for guiding the water to the channel body 61, and a circulating pump 65 that flows the water inside the tub body 21 to the supply pipe 63 (see FIG. 3).

The channel body 61 may be disposed as a channel along a space between the edge of the vibration isolator 5 and a first balancer 71, and a space between the edge of the vibration isolator 5 and a second balancer 72. The circulating pump 65 may be disposed to flow the water in the chamber 271 disposed in the water discharger to the supply pipe 63.

The channel body 61 may include a first water outlet 611, a second water outlet 613, a third water outlet 615, and a fourth water outlet 617 for discharging the water out of the channel body. The first water outlet 611 and the second water outlet 613 may be defined on a left side of the vertical line V passing through a center of the second laundry inlet 23, and the third water outlet 615 and the fourth water outlet 617 may be defined on a right side of the vertical line V.

The first water outlet 611 may be connected to a first guide 591 disposed in the vibration isolator, the second water outlet 613 may be connected to a second guide 593 disposed in the vibration isolator, the third water outlet 615 may be connected to a third guide 595 disposed in the vibration isolator, and the fourth water outlet 617 may be connected to a fourth guide 597 disposed in the vibration isolator. The guides 591, 593, 595, and 597 are means for guiding water supplied from each of the water outlets 611, 613, 615, and 617 toward the third laundry inlet 43.

In one example, in the laundry treating apparatus according to the present disclosure, the tub 2 may be further extended to the cabinet 1. This is to increase a volume of the tub to increase a volume of the drum and maximize a capacity for treating the laundry. Specifically, the tub may have a larger diameter to be closer to the cabinet.

In one example, the tub may be formed in a cylindrical shape, and the cabinet may be formed in a hexahedral shape. Therefore, a portion corresponding to a corner or an apex of the cabinet is further away from a center of the tub. Thus, the tub may be further extended toward the corner or the apex. However, because an inner face of the cabinet, such as the side panel, the top panel, or the like of the cabinet, is close to the center of the tub, the tub may be limited to extend to the corner by the inner face of the cabinet.

Therefore, in the tub according to the present disclosure, portions facing the inner face of the cabinet may be flat and remaining portions thereof may be formed in a circular shape, so that the volume of the tub may be expanded as much as possible.

In other words, in the tub body 21, a diameter of portions facing the side panels 161 and 163 of the cabinet and the top panel 17 of the cabinet and a diameter of portions facing the corners of the cabinet may be different.

The corners may correspond to portions where the front panel 13 is in contact with the first side panel 161 and the second side panel 163, portions where the top panel 17 is in contact with the first side panel 161 and the second side panel 163, and the like.

Specifically, a first flat surface 215 and a second flat surface 217 forming planes orthogonal to the base 11 may be formed on the circumferential face of the tub body 21. The first flat surface 215 may be disposed on the circumferential face of the tub body 21 in a direction toward the first side panel 161, and the second flat surface 217 may be disposed on the circumferential face of the tub body 21 in a direction toward the second side panel 163.

The fact that the first flat surface 215 is disposed orthogonal to the base 11 means that an angle between the first flat surface 215 and the base 11 with respect to a height direction (a y-axis direction) of the cabinet 1 is 90 degrees within an error range generated when the tub body 21 is manufactured. The first flat surface 215 and the second flat surface 217 are arranged to be orthogonal to the base 11 to maximize the volume of the tub body 21 installed inside the cabinet having the limited volume.

When the drum body 41 is rotated by the driver 47, vibration generated in the drum body 41 may be transmitted to the tub body 21 through a rotation shaft 475. Therefore, in a conventional tub body 21*a*, a distance between the circumferential face of the tub body and the cabinet 1 is set to be equal to or greater than a preset reference distance L1, thereby minimizing the transmission of the vibration of the tub to the cabinet.

When the first flat surface 215 and the second flat surface 217 are arranged on the circumferential face of the tub body 21, the present disclosure may provide a tub body having a volume greater than that of the conventional tub body. This is because a diameter of the tub body 21 may be set to be larger than that of the conventional tub body 21*a* when a distance between the first flat surface 215 and the first side panel 161 and a distance between the second flat surface 217 and the second side panel 163 are set to be the reference distance L1.

The first flat surface 215 included in the present disclosure may not only be orthogonal to the base 11, but also be parallel to the first side panel 161, and the second flat surface 217 may not only be perpendicular to the base 11, but also be parallel to the second side panel 163. In one example, a third flat surface 219 to which the housing is fixed may be further disposed in the region of the circumferential face of the tub body 21 above the horizontal line H passing through the center of the tub body. This is to increase an efficiency of the heater 3 by minimizing a spacing between the coil 33 and the drum body 41. The third flat surface 219 may be parallel to the base 11 or may be oblique to the base 11.

In one example, the tub may include a load portion 7 for applying a load of the tub to a portion outward of the second laundry inlet 23 or to a portion outward of the driver 47. Thus, a weight of the tub 2 may be increased, so that a width of the vibration may be reduced. Further, even when a spacing between the tub 2 and the cabinet 1 is reduced, the collision between the tub 2 and the cabinet 1 may be prevented. A specific structure of the load portion 7 will be described below.

Figure 4:
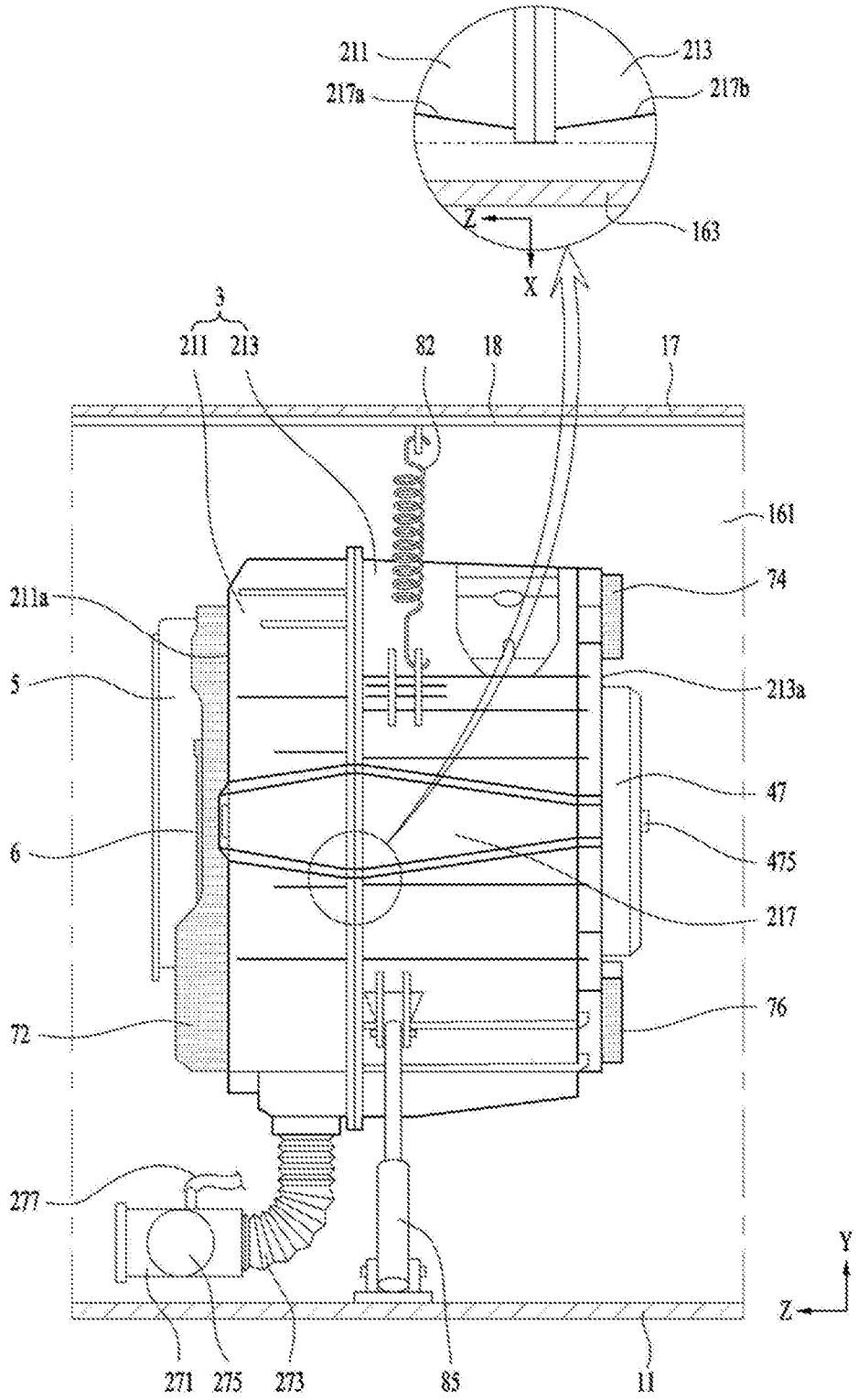

FIG. 4 illustrates a structure of the tub according to an embodiment of the present disclosure.

The tub body 21 may be provided as a tub first body 211 and a tub second body 213. This is because, when molding the tub body 21 through injection molding, it is more easy to mold the tub body 21 by coupling two bodies 211 and 213 in a shape of a cylinder with open one face with each other than to form a single tub body 21. In this case, the front cover 211*a* and the second laundry inlet 23 should be disposed on and defined in the tub first body 211, and the rear cover 213*a* should be disposed on the tub second body 213.

When the tub body 21 is formed as the tub first body 211 and the tub second body 213, the second flat surface 217 may be formed as a first face 217*a* disposed on the tub first body 211 and a second face 217*b* disposed on the tub second body 213, and the first flat surface 215 may be formed as a first face (not shown) disposed on the tub first body 211 and a second face (not shown) disposed on the tub second body 213.

When the tub first body 211 and the tub second body 213 are molded through the injection molding, the first flat surface 215 may be orthogonal to the base 11 but not be parallel to the first side panel 161, and the second flat surface 217 may be perpendicular to the base 11 but not be parallel to the second side panel 163.

In order to mold the tub first body 211, the tub second body 213, the first flat surface 215, and the second flat surface 217 through the injection molding, the first flat surface 215 should be inclined with respect to the first side panel 161, and the second flat surface 217 should be inclined with respect to the second side panel 163. This is for easy separation of molded bodies (the tub first body and the tub second body) from a mold.

That is, the first face 217*a* of the second flat surface should be disposed to be inclined in a direction to be farther away from the second side panel 163 in a direction toward the front cover 211*a*, and a first face of the first flat surface 215 should be disposed to be inclined in a direction to be farther away from the first side panel 161 in a direction toward the front cover 211*a*. Further, the second face 217*b* of the second flat surface should be disposed to be inclined in a direction to be farther away from the second side panel 163 in a direction toward the rear cover 213*a*, and a second face of the first flat surface 215 should be disposed to be inclined in a direction to be farther away from the first side panel 161 in a direction toward the rear cover 213*a*.

A distance between the first flat surface 215 and the first side panel 161, and a distance L1 between the second flat surface 217 and the second side panel 163 may be reduced by minimizing the vibration generated in the tub body 21. That is, when the vibration generated in the tub body 21 is minimized, the volume of the tub body 21 may be further increased.

Unlike conventional laundry treating apparatuses, in the present disclosure, each load portion 7 for increasing the weight of the tub body may be disposed on each of the front cover 211*a* forming the front face of the tub body and the rear cover 213*a* forming the rear face of the tub body. When the weight of the tub body is increased, great energy is required to vibrate the tub body (the tub body does not easily vibrate). Therefore, the present disclosure may minimize the vibration generated in the tub body 21. Thus, the distance between the first flat surface 215 and the first side panel 161 and the distance L1 between the second flat surface 217 and the second side panel 163 may be minimized (the volume of the tub body may be maximized).

To this end, the load portion 7 of the laundry treating apparatus 10 according to the present disclosure may further include the front load portion of the first and second balancers 71 and 72 fixed to the front cover 211*a* to increase the weight of the tub body 21, and a rear load portion of the third and fourth balancers 74 and 76 fixed to the rear cover 213*a* to increase the weight of the tub body 21.

The front load portion may include a first balancer 71 fixed to the front cover 211*a* and located on the left side of the vertical line V passing through the center of the second laundry inlet 23, and a second balancer 72 fixed to the front cover 211*a* and located on the right side of the vertical line V (see FIG. 3).

The rear load portion may include a third balancer 74 fixed to a region in a space provided by the rear cover 213*a* located above the horizontal line H passing through the center of the tub body 21, and a fourth balancer 76 located below the horizontal line H passing through the center of the tub body in the space provided by the rear cover 213*a* (see FIG. 4).

Figure 5:
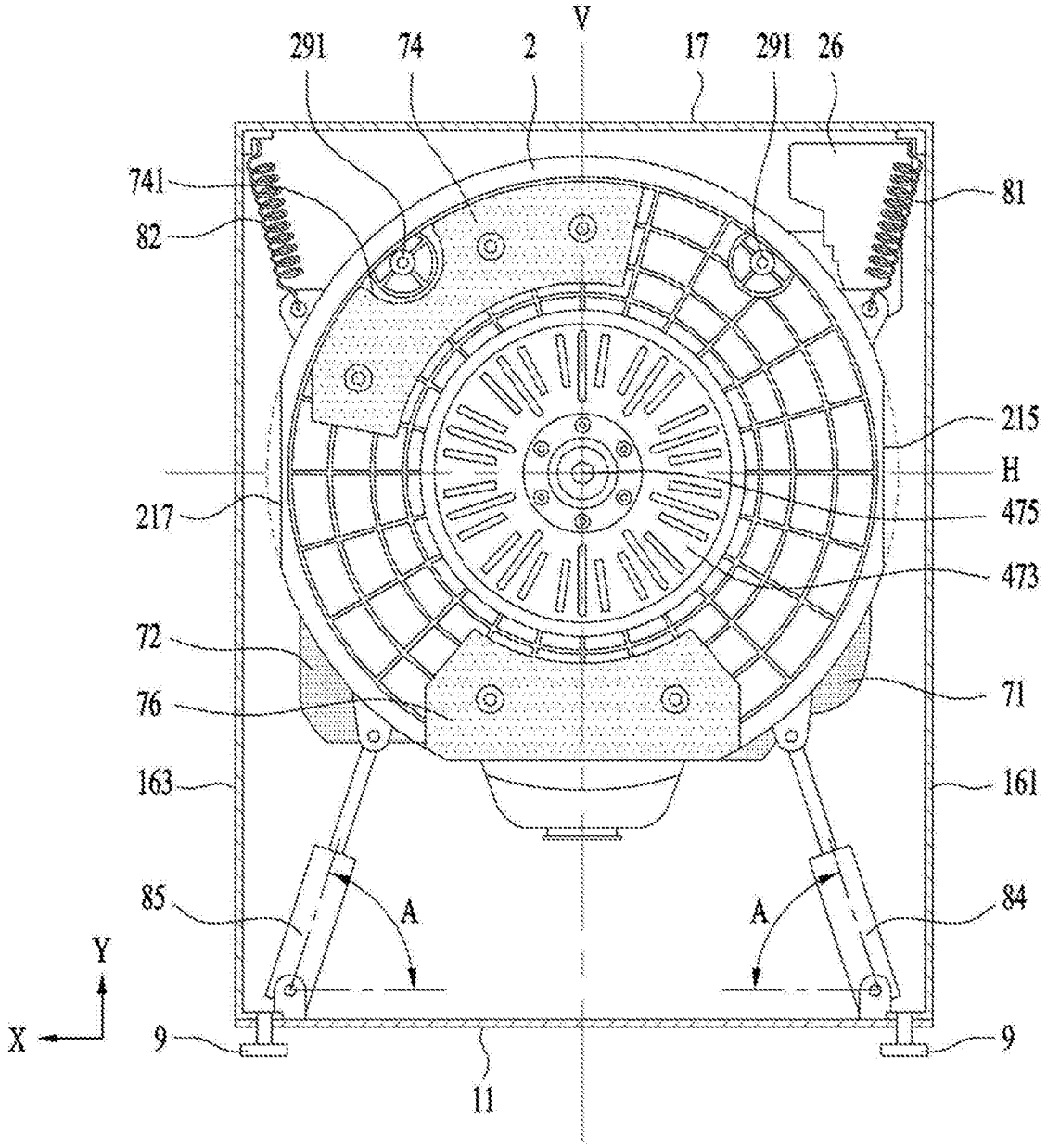

In order to minimize the vibration generated in the tub body 21 (in order to maximize the volume of the tub body), the plurality of dampers 83, 84, and 85 included in the damping portion may be arranged as shown in FIG. 5. That is, each of the plurality of dampers 83, 84, and 85 may be disposed to have an inclination angle A of 69 to 71 degrees with respect to the base 11.

When the inclination angle A of each damper with respect to the base 11 is too small, a width of the vibration in a height direction of the tub body (the y-axis direction) increases. Further, when the inclination angle A of each damper is close to 90 degrees, a width of the vibration in a left and right direction of the tub body (an x-axis direction) increases. When the inclination angle A of the damper forms 69 to 71 degrees, the widths of the vibration in the height direction of the tub body and in the left and right direction of the tub body may be minimized.

When the vibration of the tub body 21 is easily transmitted to the cabinet 1 even when the vibration generated in the tub body 21 is minimized, it is difficult to minimize the distance between the first flat surface 215 and the first side panel 161 and the distance L1 between the second flat surface 217 and the second side panel 163.

Figure 6:
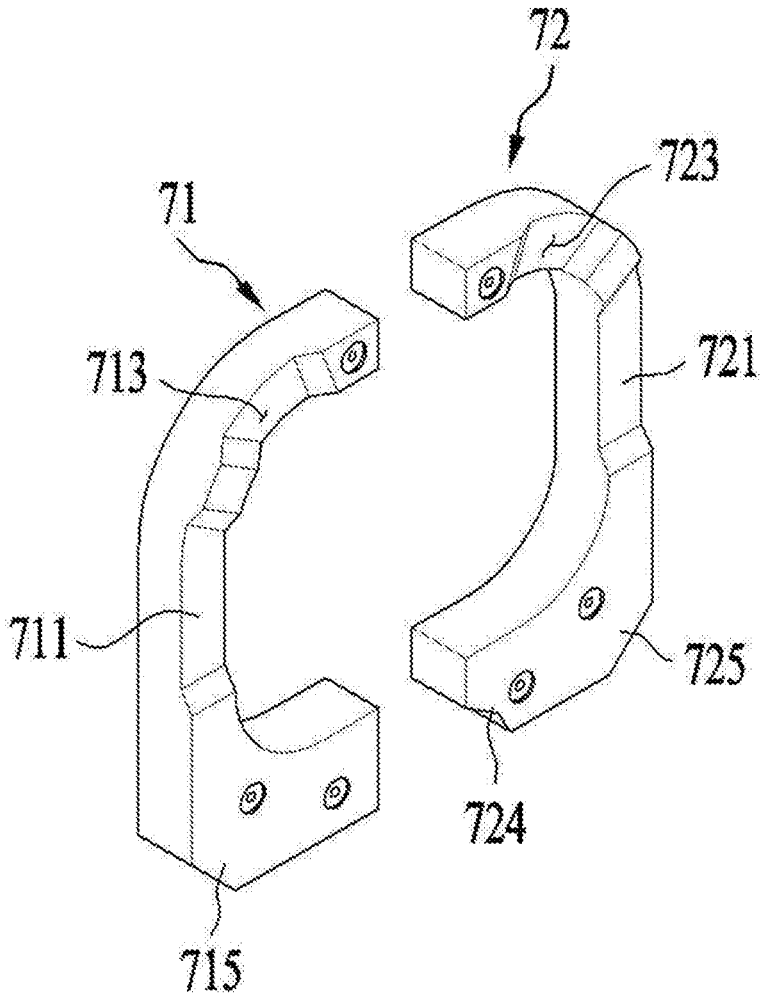
FIG. 6 illustrates an example of a front load portion included in the present disclosure.

FIG. 6 illustrates an embodiment of the balancer according to the present disclosure.

The first balancer 71 included in the present disclosure may include a first body 711 fixed to the front cover 211*a*, and a first protruding body 715 protruding from the first body 711 toward a corner where the first side panel 161 and the base 11 are coupled to each other. The first body 711 may be disposed to be located inside the space provided by the front cover 211*a*, and the first protruding body 715 may protrude to be located outside the space provided by the front cover 211*a*.

Similarly, the second balancer 72 may include a second body 721 fixed to the tub body 21 so as to be located inside the space provided by the front cover 211*a*, and a second protruding body 725 protruding from the second body 721 toward a corner where the second side panel 163 and the base 11 are connected with each other and located outside the space provided by the front cover 211*a*.

The first protruding body 715 and the second protruding body 725 are means for maximizing weights of the first balancer 71 and the second balancer 72 located inside the cabinet with the limited volume. The first protruding body 715 and the second protruding body 725 are preferably located below the horizontal line H passing through the center of the second laundry inlet 23. This is because, when a weight of a lower region of the tub body 21 is set to be greater than a weight of an upper region of the tub body, a center of gravity of the laundry treating apparatus may be lowered to prevent the laundry treating apparatus from falling because of the vibration of the tub, and the like (see FIG. 3).

Unlike a balancer disposed in the conventional laundry treating apparatus, the first balancer and the second balancer having the above-described structures may maximize a load of the front balancer through the first protruding body 715 and the second protruding body 735.

A connecting pipe receiving portion providing a space in which the connecting pipe 265 disposed in the detergent supply 26 is received may be further defined in at least one of the first body 711 and the second body 721. FIG. 3 illustrates, as an example, a case in which a connecting pipe first receiving portion 713 as a groove defined by concavely bending a surface of the first body 711 is defined in the first balancer 71, and a connecting pipe second receiving portion 723 as a groove defined by concavely bending a surface of the second body 721 is defined in the second balancer 72.

The connecting pipe receiving portions 713 and 723 are respectively defined in the two balancers 71 and 72 to prevent a center of gravity of the tub body 21 from being biased to one side of the cabinet by minimizing a weight difference between the two balancers 71 and 72 and to prevent the connecting pipe 265 from interfering with the front load portion of the first and second balancers 71 and 72 even when a position of the detergent supply 26 is changed.

When the weights of the first balancer 71 and the second balancer 72 are set to be equal to each other, it is preferable that the third balancer 74 and the fourth balancer 75 are formed in shapes symmetrical with each other with respect to the vertical line passing through the center of the rear cover 213*a*.

However, when the weights of the first balancer 71 and the second balancer 72 are not the same, it is preferable that the third balancer 74 and the fourth balancer 76 are arranged to compensate for the weight difference between the first balancer and the second balancer. FIG. 5 illustrates an example of positions and shapes of the third balancer 74 and the fourth balancer 76 for compensating for the weight difference between the first balancer and the second balancer when the weight of the first balancer 71 is set to be greater than the weight of the second balancer 72.

That is, when the weight of the first balancer 71 is set to be greater than the weight of the second balancer 72, the fourth balancer 76 may be disposed to be symmetric with respect to the vertical line V passing through the center of the tub body 21, and the third balancer 74 may be set such that a length of a region from the vertical line V to the second balancer 72 is larger than a length of a region from the vertical line V to the first balancer 71.

Unlike the above, the third balancer 74 may be disposed to be symmetric with respect to the vertical line V, and the fourth balancer 76 may be set such that a length of a region from the vertical line V to the second balancer 72 is larger than a length of a region from the vertical line V to the first balancer 71.

The weight of the first balancer and the weight of the second balancer may be different from each other for various reasons. In the present disclosure, the weights of the first and second balancers 71 and 72 may be different by a position of the residual water discharge pipe 58.

That is, in the present disclosure, a supply pipe receiving portion that provides a space for receiving the residual water discharge pipe 58 therein may be further defined in one of the first balancer 71 and the second balancer 72. Because of the supply pipe receiving portion, the weight of the first balancer 71 and the weight of the second balancer 72 may be different from each other. FIGS. 3 and 6 illustrate a case in which a supply pipe receiving portion 724 is defined in the second balancer 73.

In this case, the weight of the first balancer 71 will be greater than the weight of the second balancer 72. Thus, one of the third balancer 74 and the fourth balancer 76 should be formed in a shape symmetrical with the vertical line V passing through the center of the tub body. Further, the other of the third balancer 74 and the fourth balancer 76 should be set such that the length of the region from the vertical line V to the second balancer 72 is larger than the length of the region from the vertical line V to the first balancer 71.

When the boss 291 to which the fixing bolt 293 is fastened is disposed on the rear cover 213*a*, a fixing bolt receiving portion 741 may be further defined in the third balancer 74. The fixing bolt receiving portion 741 may be defined as a through hole penetrating the third balancer 74 or a groove defined by concavely bending an edge of the third balancer 74 (see FIG. 5).

Figure 7:
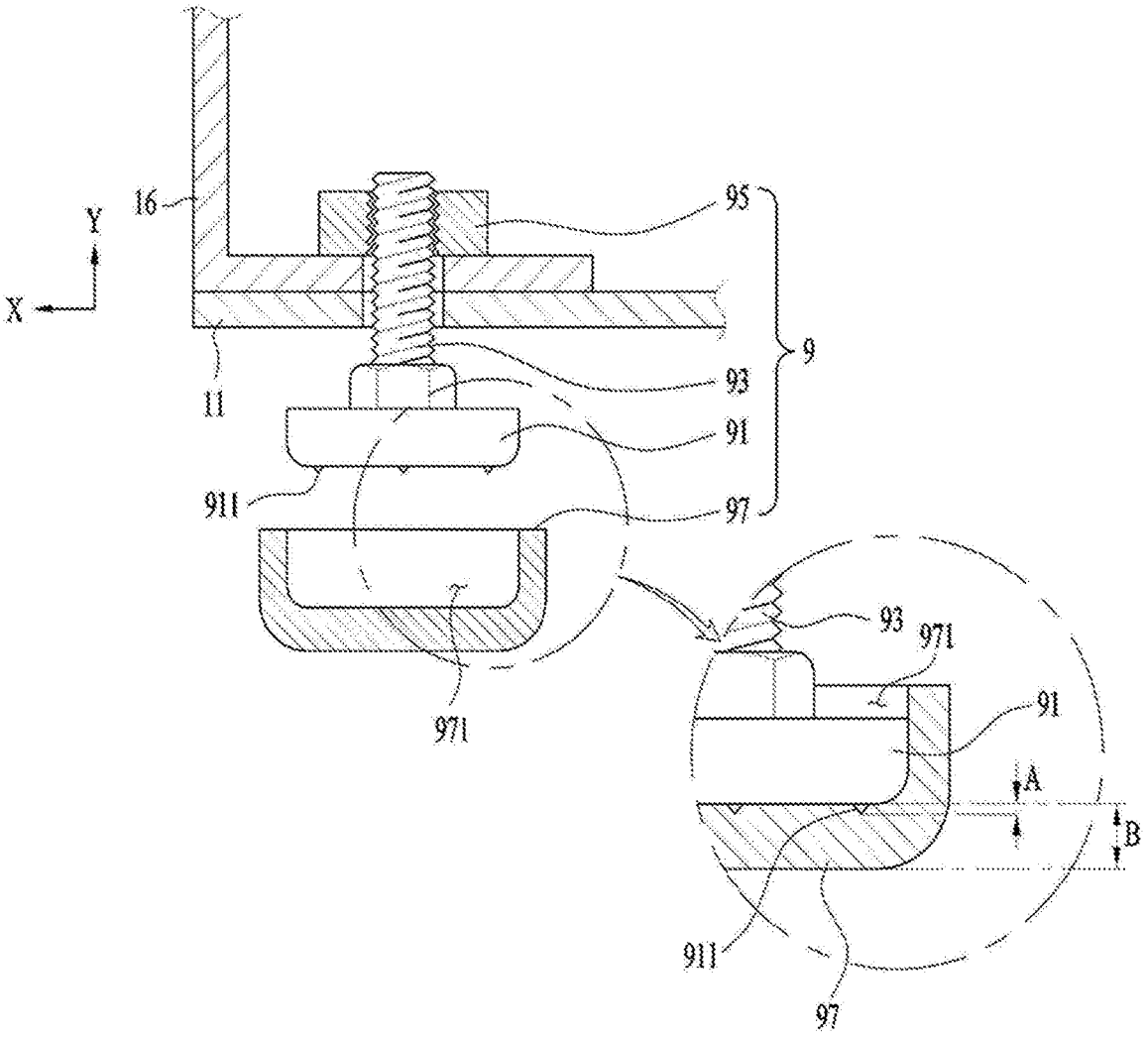
FIG. 7 illustrates an example of a cabinet vibration isolator included in the present disclosure.

FIG. 7 illustrates an embodiment of a vibration blocking portion 9 of the laundry treating apparatus according to the present disclosure.

The laundry treating apparatus 10 according to the present disclosure may further include the cabinet vibration blocking portion 9 that minimizes transmission of the vibration, which is generated in the tub body 21 and transmitted to the cabinet 1, to a face (installation face) on which the cabinet is installed.

As shown in FIG. 7, each cabinet vibration blocking portion 9 may include a fastening bodies 93 and 95 fixed to the cabinet 1, a support body 91 disposed at free ends of the fastening bodies, an insulating body 97 made of a rubber and in contact with the installation face, a body receiving groove 971 defined in the insulating body 97 to provide a space in which the support body 91 is received, and a protrusion 911 disposed on the support body 91 to prevent the support body 91 from slipping inside the body receiving groove 971.

The fastening bodies may be formed as a second fastening body 95 fixed inside the cabinet, and a first fastening body 93 passing the base 11 to be coupled to the second fastening body 95 and fixing the support body 91. The first fastening body 93 may be formed as a male screw, and the second fastening body 95 may be formed as a female screw. This is to allow a spacing between the base 11 and the support body 91 to be adjusted.

Furthermore, it is preferable that a ratio of a length A of the protrusion 911 in the height direction (the y-axis direction) of the cabinet and a thickness B of the insulating body 97 in the height direction (the y-axis direction) of the cabinet is set to 1:9 to 1:13. That is, when the length of the protrusion 911 is 0.5 mm, the thickness of the insulating body is preferably set to 4.5 mm to 6.5 mm. Therefore, the vibration of the cabinet 1 may be minimized when the drum rotates at a maximum speed. Each cabinet vibration blocking portion 9 of the above-described structure may be disposed at each corner of the base 11 as shown in FIG. 2.

Hereinafter, referring to FIGS. 8 to 12, a structure in which a control panel is installed in the laundry treating apparatus according to the present disclosure will be described.

The laundry treating apparatus according to the present disclosure may reduce an amplitude by increasing the weight of the tub 2. Thus, even when the diameter or the volume of the tub 2 is increased, a possibility of the collision between the tub 2 and the cabinet 1 may be excluded. However, in order to effectively support the tub 2 with the increased weight, and also to minimize the amplitude of the tub 2, the tub support may include a plurality of tub supports. For example, a plurality of dampers may be installed on one side of the tub 2, and a plurality of dampers may be installed on the other side of the tub 2.

However, as the number of installed dampers is increased, a process of installing the damper becomes more complicated and the space inside the cabinet is decreased, so that installation and replacement of other components become disadvantageous. Therefore, it is necessary to consider an optimized number or positions of the plurality of dampers.

In the laundry treating apparatus according to the present disclosure, the load of the tub 2 is asymmetric with respect to the rotation shaft by a shape and a disposition of the load portion 7, a shape of the tub, locations of the water supply and water discharger, and the like. Therefore, it is preferable that the plurality of dampers are also arranged asymmetrically with respect to the rotation shaft, and it is preferable that a greater number of dampers are installed in a portion where the load of the tub 2 is more imposed.

For example, the number of dampers installed in a portion proximate to the first flat surface 215 may be greater than the number of dampers installed in a portion proximate to the second flat surface 217. That is, the number of dampers installed in the portion adjacent to the second flat surface 217 may be smaller than the number of dampers installed in the portion adjacent to the first flat surface 215. Accordingly, more space may be secured below the second flat surface 217, and an operation of installing the damper below the second flat surface 217 may become easier.

In the following, the laundry treating apparatus according to the present disclosure will be described on the basis that two dampers are installed on one side of the tub with the first flat surface 215, and one damper is installed on the other side of the tub with the second flat surface 217. However, this is only an embodiment, and any number of dampers may be arranged as long as the plurality of dampers may be arranged asymmetrically.

Figure 8:
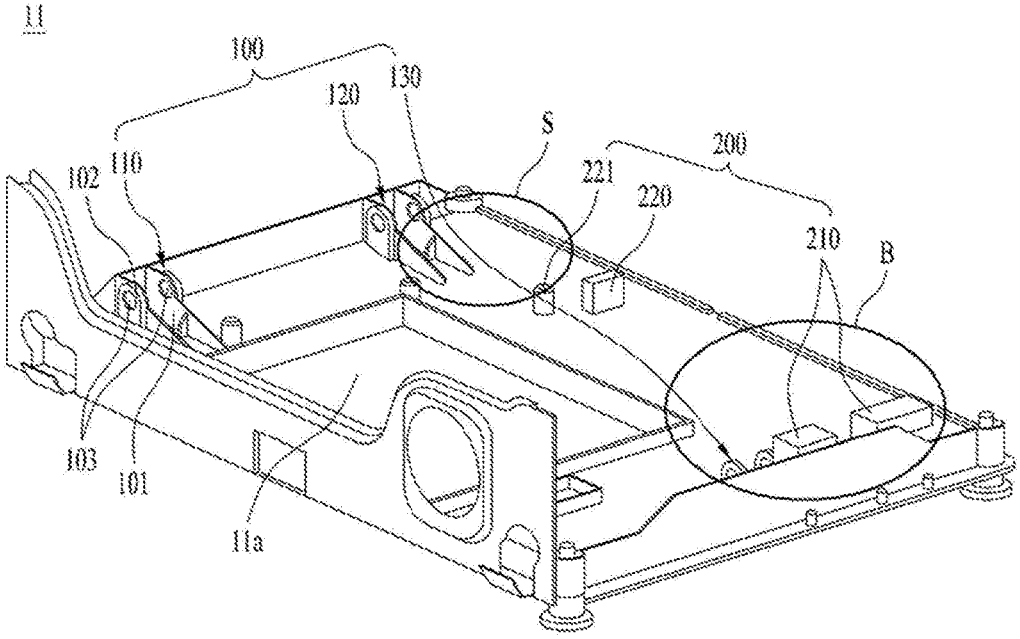
FIG. 8 illustrates a structure of a base according to the present disclosure.

FIG. 8 illustrates another embodiment of the base 11 of the laundry treating apparatus according to the present disclosure.

The plurality of dampers 83, 84, and 85 of the laundry treating apparatus according to the present disclosure are coupled to the cabinet 1 to support the tub 2, and specifically are coupled to the base 11. To this end, the base 11 may include a damper coupling portion 100 having a plurality of coupling portions to which the plurality of dampers 83, 84, and 85 are respectively coupled.

Specifically, the plurality of dampers may include the first damper 83 coupled to a bottom of the first flat surface 215 of the tub, the second damper 84 spaced apart from the first damper 83 in a second laundry inlet direction and coupled to a bottom of the first flat surface, and the third damper 85 coupled to a bottom of the second flat surface of the tub. Each of the plurality of coupling portions may be disposed at a position of the base 11 corresponding to one end or a bottom of each of the plurality of dampers. Specifically, the damper coupling portion 100 may include a first coupling portion 110 for coupling the first damper 83 to the base 11, a second coupling portion 120 for coupling the second damper 84 to the base 11, and a third coupling portion 130 for coupling the third damper to the base 11.

The plurality of coupling portions may be integrally formed with the base 11 or may be coupled to the base 11 so as to be respectively coupled to free ends or distal ends of the first damper 83, the second damper 84, and the third damper 85. In addition, all of the plurality of coupling portions may have the same structure when shapes of the distal ends of the first damper 83, the second damper 84, and the third damper 85 are the same.

In one example, the damper coupling portion 100 and the dampers may be coupled by a coupling hook formed in a pin or a pipe shape. The coupling hook 300 may be disposed to penetrate the damper coupling portion 100 and the ends of the dampers to fix the dampers to the damper coupling portion 100.

Specifically, the damper coupling portion 100 may include a first fixture 101 protruding from the base 11 and disposed on one side of each of the dampers, and a second fixture 102 spaced apart from the first fixture 101 by a distance corresponding to a thickness of the damper or greater, and protruding from the base 11. In addition, the first fixture 101 and the second fixture 102 may be arranged to face each other, so that an insertion hole 103 to be inserted by the coupling hook 300 may be defined.

In one example, the laundry treating apparatus according to the present disclosure may further include a control panel 300 disposed to control the driver, the water supply valve, the water discharge pump, and the like. The control panel may include a main microcomputer to receive a signal for controlling the laundry treating apparatus and provide a command for controlling the laundry treating apparatus. In addition, the tub 2 of the laundry treating apparatus according to the present disclosure may be extended to be close to the cabinet as much as possible. Therefore, a space above the tub 2 into which the control panel 300 for controlling the laundry treating apparatus is disposed may be small. Further, the panel 300 and the tub 2 may collide with each other when strong vibration is transmitted to the tub 2.

Even when the tub is expanded, the space between the lower surface of the tub and the base 11 may be more sufficient than the space between the top of the tub and the base 11 because of a length of the damper itself.

Therefore, the control panel 300 of the laundry treating apparatus according to the present disclosure may be disposed between the lower surface of the tub 2 and the cabinet 1 not in a front or an upper portion of the cabinet 1. Specifically, the control panel 300 may be installed on the base 11.

However, because the first coupling portion 110 and the second coupling portion 120 are adjacent to each other, a region S around the first coupling portion 110 and the second coupling portion 120 may have a narrow space for installing the control panel therein. In addition, the first damper 83 and the second damper 84 respectively coupled to the first coupling portion 110 and the second coupling portion 120 may act as obstacles in installing or repairing the control panel 300. On the other hand, a region B around the third coupling portion 130 may have a relatively wider space, and the number of dampers to act as the obstacle in installing or repairing the control panel 300 may be smaller. As a result, among the region B and the region S of the base 11, the region B may have a wider space than the region S and may not be limited by components such as the damper.

The control panel 300 may be spaced apart from all of the plurality of coupling portions and installed on the base 11. In addition, the control panel 300 may be disposed on the base 11 to be biased to the third coupling portion 130 than to the first coupling portion 110 or the second coupling portion 120.

In addition, the base 11 may further include a panel fixing portion 200 that guides the control panel to be installed in a manner of being biased toward the third coupling portion 130. The panel fixing portion 200 may further include a first fixing portion 210 for supporting one side of the control panel, and a second fixing portion 220 for supporting the other side of the control panel. That is, the first fixing portion 210 and the second fixing portion 220 may induce the control panel 300 to be installed in the region B. In addition, the panel fixing portion 200 may further include an installation portion 221 for fixing or installing an electric wire or a harness.

Figure 9:
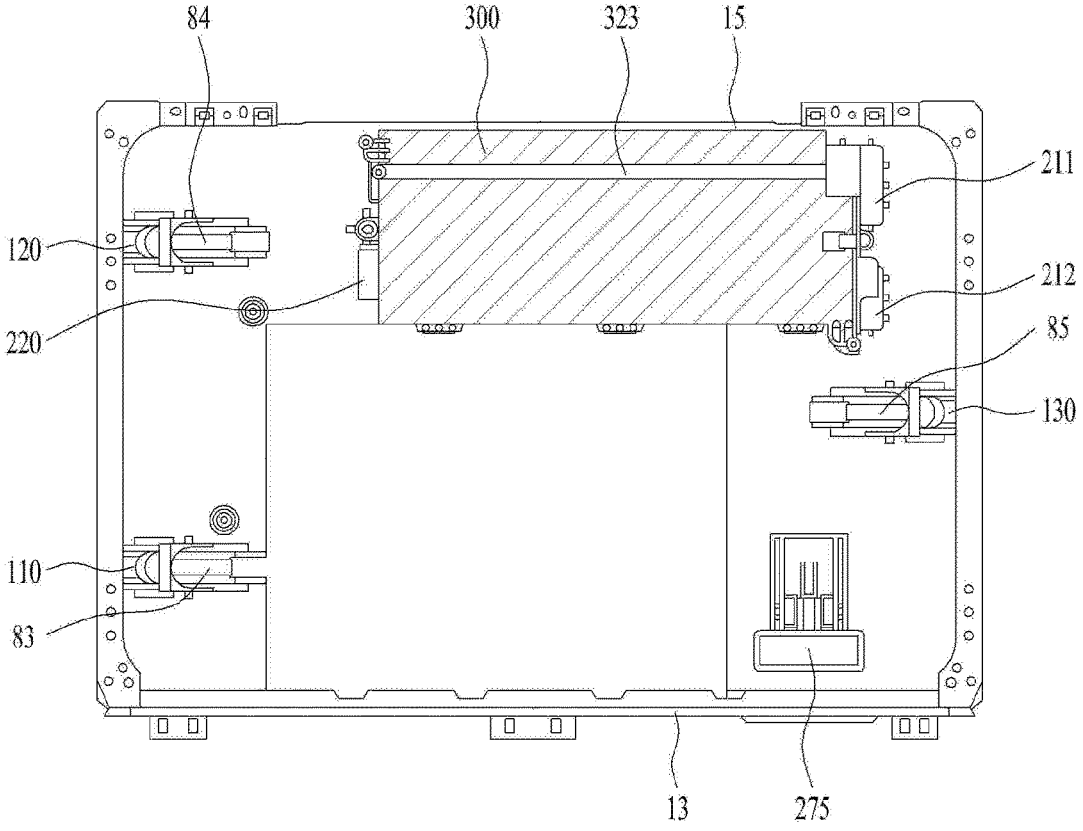
FIG. 9 illustrates a structure in which a control panel is installed on a base according to the present disclosure.

FIG. 9 illustrates a structure in which a control panel for controlling a laundry treating apparatus according to an embodiment of the present disclosure is coupled.

The control panel 300 may be installed on the base 11, and may be disposed to be closer to or more biased to the third coupling portion 130 than to the first coupling portion 110 or the second coupling portion 120. In other words, the control panel 300 may be disposed to be spaced apart from the first coupling portion 110 and the second coupling portion 120 toward the second flat surface 217.

The control panel 300 may be disposed between the third coupling portion 130 and the front panel 13 of the cabinet or between the third coupling portion and the rear panel 15 of the cabinet.

That is, the control panel 300 may be disposed frontward or rearward of the third coupling portion 130, and the third coupling portion 130 may be disposed to face one face of the control panel 300. There may be a region where the control panel 300 overlaps with the third coupling portion 130 in a rotation shaft direction, but the control panel 300 may not overlap with the first coupling portion 110 and the second coupling portion 120.

In addition, the control panel 300 may be disposed such that the third coupling portion 130 is disposed between the control panel 300 and the water discharge pump 275. The control panel 300 may be installed in a space in which the water discharge pump 275 is not installed. The water discharge pump 275 is generally disposed to face the front panel 13 of the base 11 such that a filter of the water discharge pump 275 may be easily exposed or replaced. Therefore, the control panel 300 may be installed to be spaced apart from the third coupling portion 130 toward the rear panel 15.

The control panel 300 may be formed in a plate shape, and one face of the control panel 300 corresponding to a width rather than a thickness of the control panel 300 may be disposed to be in contact with the base 11. Thus, the tub may be further extended toward the base 11.

The base 11 may include the panel fixing portion 200 for seating both ends of the control panel 300 thereon or being coupled to the both ends of the control panel 300. The panel fixing portion 200 may firmly fix the control panel 300 such that the control panel 300 does not unnecessarily vibrate.

In one example, the base 11 may further include a communication portion 11*a* having a portion in a front face or a central portion that is opened. This is to prevent the water leaked from the tub from accumulating in the cabinet.

Figure 10:
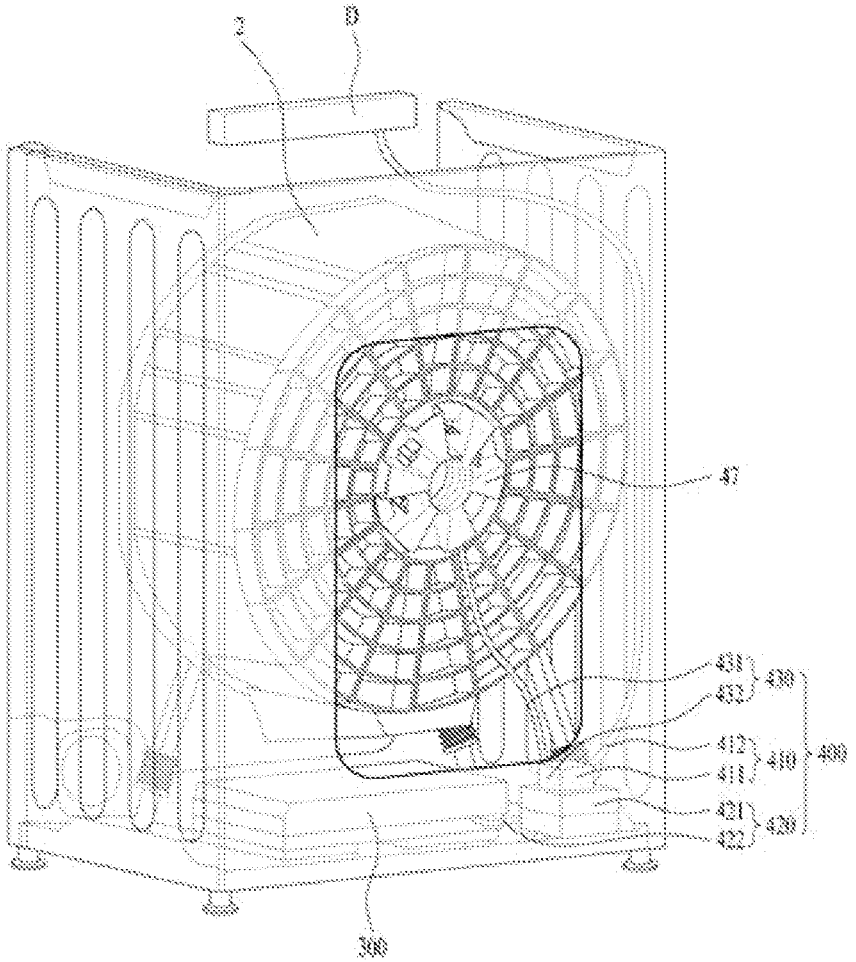
FIG. 10 illustrates disposition of a harness connecting a control panel, a driver, and a display panel with each other according to the present disclosure with each other.

FIG. 10 illustrates an embodiment in which harnesses of a control panel, a display panel, and a driver are coupled to each other.

Generally, a display for displaying a state of the laundry treating apparatus and a display panel D for controlling the same may be installed on the top face or the front face of the cabinet. The display panel D is preferably disposed to be adjacent to the display. However, because the control panel 300 for controlling the driver, the water supply, the water discharger of the laundry treating apparatus is coupled to the base 11, the control panel 300 and the display panel D are spaced apart from each other.

In addition, because the driver needs to be immediately controlled by the control panel 300, the driver and the control panel 300 need to be electrically connected with each other.

Accordingly, the laundry treating apparatus according to an embodiment of the present disclosure may further include a harness 400 that may be electrically connected to the control panel 300, the display panel D, and the driver.

The harness 400 may include electric wires respectively extending from the control panel 300, the display panel D, and the driver 47, and coupling portions respectively arranged at and coupled to free ends of the wires. A known wire coupling structure may be applied to a specific structure of the harness 400.

The harness 400 may include a display harness 410 extended from the display panel D toward one side or the rear face of the tub, and a main harness 420 extended from the control panel 300 and detachably coupled to the display harness 410.

The display harness 410 and the main harness 420 may be coupled to each other on the base 11. Therefore, even when the vibration is transmitted to the harness 400, the display harness 410 and the main harness 420 may be prevented from being separated from each other.

In one example, the display harness 410 and the main harness 420 may be closer to the first coupling portion 110 and the second coupling portion 120 than to the third coupling portion 130. In addition, the display harness 410 and the main harness 420 may be coupled to each other at a position between the control panel 300 and one of the first coupling portion 110 and the second coupling portion 120. This is because the harness 400 occupies less installation space than the control panel 300. Further, this is for preventing the harness 400 from impacting the control panel 300.

In addition, the display harness 410 and the main harness 420 may be coupled to each other at a position between the control panel and one of the first coupling portion and the second coupling portion. Thus, the control panel 300 and the harness 400 may be arranged side by side to facilitate repair and installation.

In one example, the display harness 410 and the main harness 420 may be coupled to each other at a position between the first coupling portion 110 and the second coupling portion 120. This is because volumes of the display harness 410 and the main harness 420 are not greater than that of the control panel 300, and thus the display harness 410 and the main harness 420 may be sufficiently installed between the first coupling portion 110 and the second coupling portion 120.

In one example, the harness 400 may include a driver harness 430 extending from the driver 47 to exchange information with the control panel.

The driver harness 430 and the main harness 420 may be coupled to each other on the base 11. Therefore, even when the vibration is transmitted to the harness 400, the driver harness 430 and the main harness 420 may be prevented from being separated from each other.

In one example, the driver harness 430 and the main harness 420 may be closer to the first coupling portion 110 and the second coupling portion 120 than to the third coupling portion 130. In addition, the driver harness 430 and the main harness 420 may be coupled to each other at a position between the control panel 300 and one of the first coupling portion 110 and the second coupling portion 120. This is because the harness 400 occupies less installation space than the control panel 300. Further, this is for preventing the harness 400 from impacting the control panel 300.

In addition, the driver harness 430 and the main harness 420 may be coupled to each other at a position between the control panel and one of the first coupling portion and the second coupling portion. Thus, the control panel 300 and the harness 400 may be arranged side by side to facilitate the repair and the installation.

In one example, the driver harness 430 and the main harness 420 may be coupled to each other at a position between the first coupling portion 110 and the second coupling portion 120. This is because volumes of the driver harness 430 and the main harness 420 are not greater than that of the control panel 300, and thus the driver harness 430 and the main harness 420 may be sufficiently installed between the first coupling portion 110 and the second coupling portion 120.

In addition, all the main harness 420, the display harness 410, and the driver harness 430 may be coupled to each other all at once.

The harness 400 including the main harness 420, the display harness 410, and the driver harness 430 may be fixed to the second fixing portion 220 disposed on the base 11, or may be fixed to the installation portion 221. That is, the harness 400 may be disposed in the region S, and the control panel 300 may be disposed in the region B. Therefore, the fixing portion 200 may fix the harness 400 as well as the control panel 300 to the base 11, and may prevent the harness 400 from being separated or being changed in position by the vibration.

The display harness 410 may include a display wire 412 extending from the display panel D and a display detachable portion 411 coupled to a free end of the display wire 412. The main harness 420 may include a main wire 422 extending from the control panel 300 and a main detachable portion 421 coupled to a free end of the main wire 422. The driver harness 430 may include a driving wire 431 extending from the driver 47 and a driving detachable portion 432 coupled to a free end of the driving wire 431. At least one of the driving detachable portion 432 and the display detachable portion 411 may be detachably coupled to the main detachable portion 421.

Figure 11:
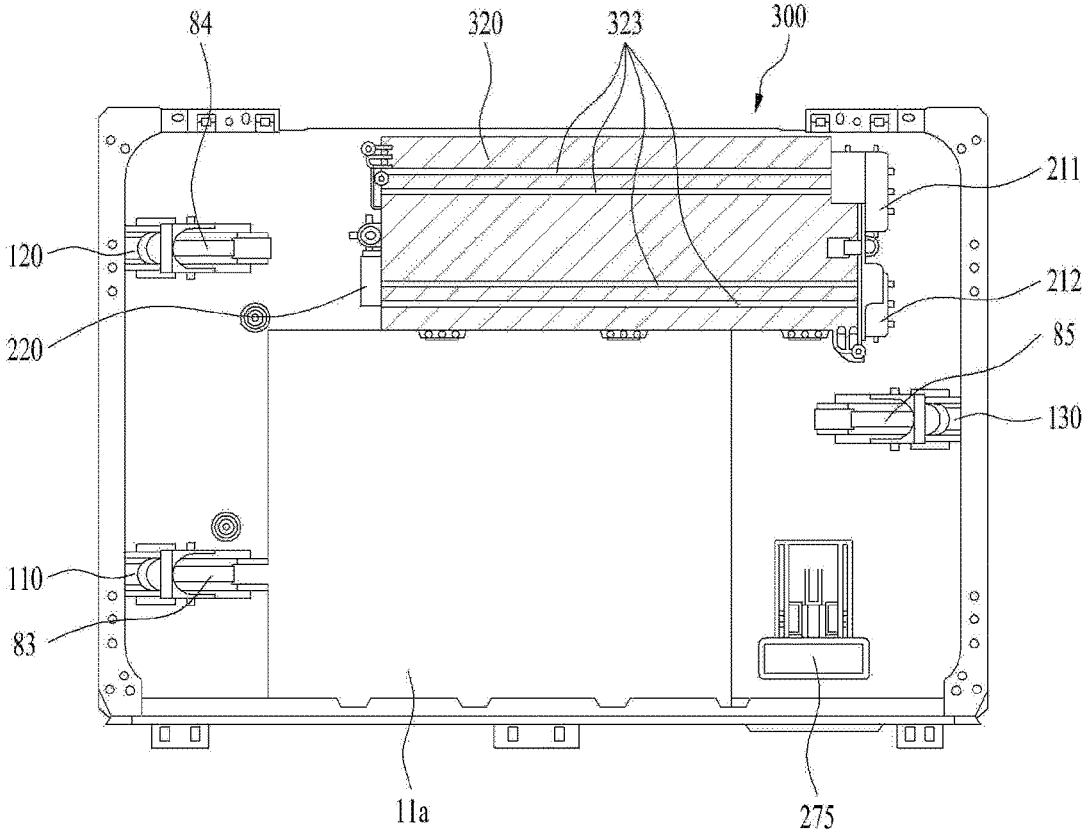
FIG. 11 illustrates a top structure of a control panel according to the present disclosure.

FIG. 11 illustrates an additional embodiment of the control panel.

The control panel 300 may include a circuit board 310 capable of controlling the components of the laundry treating apparatus and a panel cover 320 for shielding the circuit board 310 from being exposed to the outside. A coupling rib 321 coupled to the panel fixing portion 200 or the base 11 may be extended from an outer portion of the panel cover 320. A drain groove 323 may be defined in a top face of the panel cover 320.

In one example, the drain groove 323 may include a plurality of drain grooves, and may be extended in a length direction or in a width direction of the control panel.

The control panel 300 may be disposed on the base 11 in an inclined manner such that water input to the drain groove 323 may be immediately discharged from the control panel 300. One end of the control panel 300 may be positioned a higher than the other end.

In addition, the drain groove 323 itself may be defined in an inclined manner. In other words, regardless of a height of the control panel 300, a depth of the drain groove 323 may become deeper in a direction from one end to the other end of the drain groove 323.

Thus, the water leaked from the tub 2 to the control panel may be immediately removed from the control panel. In addition, when the plurality of drain grooves are spaced apart from each other, the leaked water may be removed regardless of which portion of a top face of the control panel 300 the leaked water falls to.

Figure 12:
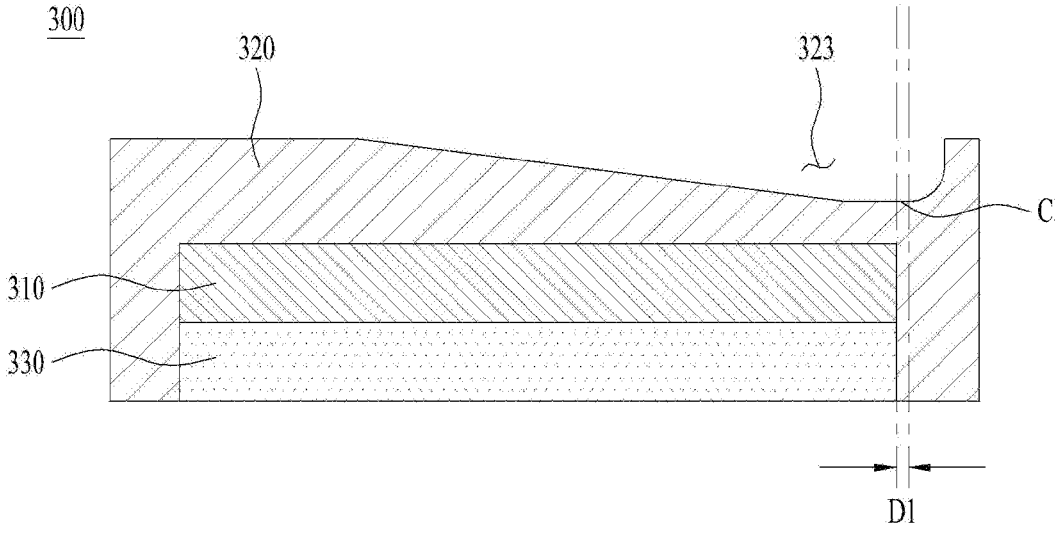
FIG. 12 illustrates a cross-sectional structure of a control panel according to the present disclosure.

FIG. 12 illustrates a cross-sectional view of the control panel.

The drain groove 323 defined in the panel cover 320 may be defined to avoid the circuit board 310 as much as possible. In addition, a lowermost portion c of the drain groove 323 may be spaced apart from the circuit board 310 so as not to overlap with a vertical direction of the circuit board 310. The lowermost portion c of a cross-section of the drain groove 323 may be spaced apart from a distal end of the circuit board 310 by D1 in the vertical direction. Therefore, the water collected in the drain groove 323 may be fundamentally blocked from being transmitted to the circuit board 310.

In addition, a buffer member 330 for minimizing the vibration transmission to the circuit board and protecting the circuit board from an external impact may be installed below the circuit board 310. A face of the buffer member 330 in contact with the circuit board may be inclined. In addition, the buffer member 330 may be received in the panel cover 320 as illustrated, or may be disposed to support the panel cover 320 unlike as illustrated.

Because the present disclosure may be modified and implemented in other forms, the scope of the present disclosure is not limited to the above-described embodiment. Thus, the modifications should be regarded as falling within a scope of the present disclosure when the modifications are carried out so as to include a component claimed in the claims or within a scope of an equivalent thereto.

What is claimed is:

1. A laundry treating apparatus comprising:

a cabinet that defines an opening at a front face of the cabinet;

a door configured to open or close the opening of the cabinet;

a tub located in the cabinet and defining an inlet that is in fluid communication with the opening of the cabinet;

a water valve coupled to the cabinet and configured to supply water into the tub;

a water pump located below the tub and configured to discharge water out of the tub;

a drum rotatably provided inside the tub and configured to receive laundry;

a driver coupled to the tub and configured to rotate the drum;

a plurality of dampers connected the tub and configured to support the tub; and a control panel being configured to control the water supply, the water pump, and the driver, wherein the cabinet comprises a base configured to receive the control panel, the plurality of dampers and the water pump being mounted to the base, wherein the control panel is disposed closer to the driver than to the door.

2. The laundry treating apparatus of claim 1, further comprising:

a damper coupling portion including a plurality of coupling portions that are located on the base and that are coupled to the plurality of dampers, wherein the control panel is spaced from the damper coupling portion.

3. The laundry treating apparatus of claim 2, wherein a first flat surface of the tub is provided on a first side of the tub and faces a first side of the cabinet, wherein a second flat surface of the tub is provided on a second side of the tub and faces a second side of the cabinet, wherein the plurality of dampers comprise:

a first damper coupled to a surface of the tub below the first flat surface of the tub;

a second damper that is spaced apart from the first damper in a direction toward the inlet and coupled to the surface of the tub below the first flat surface; and a third damper coupled to a surface of the tub below the second flat surface of the tub, wherein the damper coupling portion comprises:

a first coupling portion coupled to the first damper;

a second coupling portion coupled to the second damper; and a third coupling portion coupled to the third damper, and wherein the control panel is located closer to the third coupling portion than to the first coupling portion and the second coupling portion.

4. The laundry treating apparatus of claim 3, wherein the control panel is spaced apart from the first and the second coupling portions toward the third coupling portion.

5. The laundry treating apparatus of claim 3, wherein the cabinet further comprises:

a front panel that includes the opening; and a rear panel that forms a rear face of the cabinet, and wherein the control panel is located between the third coupling portion and the front panel of the cabinet or between the third coupling portion and the rear panel of the cabinet.

6. The laundry treating apparatus of claim 3, wherein the third coupling portion is located between the control panel and the water pump.

7. The laundry treating apparatus of claim 3, further comprising:

a display located at the front face or a top face of the cabinet and configured to display a state of the laundry treating apparatus;

a display panel configured to control the display;

a display harness that provides an electrical connection between the display panel and the control panel; and a main harness coupled to the display harness, wherein the display harness and the main harness are coupled to each other at the base.

8. The laundry treating apparatus of claim 7, wherein the display harness and the main harness are coupled to each other at a position closer to the first coupling portion or the second coupling portion than to the third coupling portion.

9. The laundry treating apparatus of claim 7, wherein the display harness and the main harness are coupled to each other at a position between the control panel and one of the first coupling portion or the second coupling portion.

10. The laundry treating apparatus of claim 7, wherein the display harness and the main harness are coupled to each other at a position between the first coupling portion and the second coupling portion.

11. The laundry treating apparatus of claim 7, wherein the display harness and the main harness are coupled to the base.

12. The laundry treating apparatus of claim 7, further comprising:

a driver harness that provides an electrical connection between the driver and the control panel, wherein the control panel includes the main harness coupled to the driver harness, and wherein the driver harness and the main harness are coupled to each other and are disposed at the base.

13. The laundry treating apparatus of claim 12, wherein the driver harness and the main harness are coupled to each other at a position closer to the first coupling portion or the second coupling portion than to the third coupling portion.

14. The laundry treating apparatus of claim 1, wherein the control panel includes:

a circuit board configured to control at least one of the driver, the water valve, or the water pump;

a buffer member located between the circuit board and a bottom face of the cabinet and configured to reduce vibration transmitted to the circuit board; and a panel cover configured to shield the circuit board from moisture.

15. The laundry treating apparatus of claim 14, wherein the panel cover defines a drain groove that is concave from a top face of the panel cover and that is configured to discharge moisture.

16. The laundry treating apparatus of claim 1, wherein the tub includes a first flat surface provided on a first side of the tub and a second flat surface provided on a second side of the tub facing the first side of the tub, and wherein a radius of curvature each of the first flat surface and second flat surface is greater than a radius of curvature of a lower surface of the tub.

17. A laundry treating apparatus comprising:

a cabinet that defines an opening at a front face of the cabinet and that includes a base forming a bottom face of the cabinet;

a tub located in the cabinet and defining an inlet that is in fluid communication with the opening of the cabinet;

a water valve coupled to the cabinet and configured to supply water into the tub;

a water pump located below the tub and configured to discharge water out of the tub;

a drum rotatably provided inside the tub and configured to receive laundry;

a driver coupled to the tub and configured to rotate the drum;

a plurality of dampers connected to the base to support the tub;

a damper coupling portion including a plurality of coupling portions that are located on the base and that are coupled to the plurality of dampers; and a control panel configured to control the water valve, the water pump, and the driver, wherein the control panel is located at the base and is spaced from the damper coupling portion, and wherein the control panel is placed closer to a rear side of the base than to a front side of the base.

18. The laundry treating apparatus of claim 17, wherein the plurality of dampers comprise:

a first damper coupled to a surface of the tub below a first flat surface of the tub provided on a first side of the tub;

a second damper that is spaced apart from the first damper in a direction toward the inlet and coupled to the surface of the tub below the first flat surface; and a third damper coupled to a surface of the tub below a second flat surface of the tub provided on a second side of the tub, wherein the damper coupling portion comprises:

a first coupling portion coupled to the first damper;

a second coupling portion coupled to the second damper; and a third coupling portion coupled to the third damper, and wherein the control panel is located closer to the third coupling portion than to the first coupling portion and the second coupling portion.

19. The laundry treating apparatus of claim 18, further comprising:

a display located at the front face or a top face of the cabinet and configured to display a state of the laundry treating apparatus;

a display panel configured to control the display;

a display harness that provides an electrical connection between the display panel and the control panel; and a driver harness that provides an electrical connection between the driver and the control panel, a main harness coupled to the display harness and the driver harness, and wherein the driver harness and the display harness are coupled to each other at a position closer to the first coupling portion or the second coupling portion than to the third coupling portion.

20. The laundry treating apparatus of claim 17, wherein the control panel includes:

a circuit board configured to control at least one of the driver, the water valve, or the water pump;

a buffer member located between the circuit board and a bottom face of the cabinet and configured to reduce vibration transmitted to the circuit board; and a panel cover configured to shield the circuit board from moisture.

* * * * *